US007367431B2

(12) United States Patent
Ach

(10) Patent No.: US 7,367,431 B2
(45) Date of Patent: May 6, 2008

(54) ELEVATOR SYSTEM

(75) Inventor: Ernst Friedrich Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 292 days.

(21) Appl. No.: 10/849,970

(22) Filed: May 20, 2004

(65) Prior Publication Data

US 2004/0216958 A1 Nov. 4, 2004

(51) Int. Cl.
*B66B 11/00* (2006.01)

(52) U.S. Cl. ..... 187/255; 187/254; 187/266; 187/268

(58) Field of Classification Search ..... 187/254, 187/255, 266; 474/268
See application file for complete search history.

(56) References Cited

U.S. PATENT DOCUMENTS

| | | | | |
|---|---|---|---|---|
| 5,025,893 | A * | 6/1991 | Saito | 187/266 |
| 5,387,160 | A * | 2/1995 | Nakajima et al. | 474/205 |
| 5,891,561 | A * | 4/1999 | Kinoshita et al. | 428/295.1 |
| 5,944,144 | A * | 8/1999 | Hein | 187/254 |
| 6,056,656 | A * | 5/2000 | Kitano et al. | 474/268 |
| 6,471,012 | B2 * | 10/2002 | Faletto | 187/256 |
| 2002/0098935 | A1 * | 7/2002 | Danhauer et al. | 474/261 |
| 2003/0121729 | A1 * | 7/2003 | Heinz et al. | 187/254 |

FOREIGN PATENT DOCUMENTS

| | | | |
|---|---|---|---|
| EP | 1 149 795 | | 10/2001 |
| WO | WO 99/43589 | * | 9/1999 |
| WO | WO 99/43593 | | 9/1999 |

* cited by examiner

*Primary Examiner*—Patrick Mackey
*Assistant Examiner*—Terrell Matthews
(74) *Attorney, Agent, or Firm*—Fraser Clemens; Martin & Miller LLC; William J. Clemens

(57) ABSTRACT

A wedge-ribbed belt supports an elevator car by underlooping and engages a drive pulley of a drive mounted at the head of an elevator shaft. The belt has a running surface facing the drive pulley with a plurality of ribs and grooves extending in parallel in a longitudinal direction of the belt. The ribs and grooves can be triangular-shaped or trapezium-shaped in cross section. A plane of the drive pulley is arranged vertically and at right angles to a car wall at a counterweight side of the elevator car and approximately in a middle of a car depth with a vertical projection of the drive pulley onto the counterweight side being outside a vertical projection of the counterweight side. A part of a vertical projection of the drive motor is superimposed on the vertical projection of the counterweight side of the elevator car.

12 Claims, 2 Drawing Sheets

ELEVATOR SYSTEM

BACKGROUND OF THE INVENTION

The present invention relates to elevator systems having flat belts supporting the elevator car.

Elevator systems of the kind according to the present invention usually comprise an elevator car and a counterweight, which are movable in an elevator shaft or along free-standing guide devices. For producing movement, the elevator system comprises at least one drive with at least one respective drive pulley which by way of support and drive means supports the elevator car and the counterweight and transmits the necessary drive forces to these.

The support or the drive means are termed support means in the following description.

In the case of conventional elevator systems, steel cables with a round cross-section are usually used as support means. However, flat belt-like support means are increasingly used for more modem systems.

An elevator system with a flat-belt-like support means is shown in the PCT Patent Application WO 99/43593. In the embodiment illustrated therein by FIG. 6 the elevator system comprises a drive motor which is arranged in the elevator shaft above the elevator car and acts by way of at least one drive pulley on at least one flat support means strand by which an elevator car and a counterweight arranged on the side thereof can be moved upwardly and downwardly. The flat-belt-like support means in that case runs from one side of the drive pulley horizontally to a first deflecting roller, runs around this through 90°, then extends downwardly along the car wall at the counterweight side, loops by 90° around each of two car support rollers mounted on respective sides below the elevator car and runs upwardly along a car wall remote from the counterweight to a first support means fixing point present in the upper region of the elevator shaft. From the other side of the drive pulley the support means runs horizontally to a second deflecting roller, runs around this by 90°, then extends downwardly to the side, which is at the car side, of the periphery of a counterweight support roller, loops around this by 180° and runs vertically to a second support means fixing point in the shaft head region.

Such an elevator system has, thanks to the use of a flat-belt-like support means, the advantage that drive pulleys as well as deflecting and support rollers can be used with substantially smaller diameters than would be required in the case of the use of conventional wire cables. Due to the smaller drive pulley diameter the drive torque required at the drive pulley is reduced, whereby a drive motor with smaller dimensions can be used. Thanks to the generally smaller support means pulley diameter it is possible to realize simpler and space-saving elevator systems.

However, the elevator systems described in the WO 99/43593 publication have certain disadvantages.

As a consequence of the small drive pulley diameter, and because in the case of use of flat belts as support means known measures for improving the traction capability, for example undercutting of the cable grooves at drive pulleys for round support means, are not usable, the problem can arise in the case of a relatively large weight ratio between fully laden and empty elevator car that the traction forces transmissible between drive pulley and flat-belt-like traction means are not sufficient.

Moreover, it is known that in the case of use of flat-belt-like support means without profiling of the running surface substantial problems with the lateral guidance of the support means on the drive pulley, deflecting rollers and the support rollers arise. Experience has shown that there is a risk that the support means so strongly rubs against the lateral boundary discs usually present at the drive pulleys, deflecting rollers and support rollers that the support means are damaged.

SUMMARY OF THE INVENTION

The present invention has an object of creating an elevator system with flat-belt-like support means which does not exhibit the above-mentioned disadvantages.

The proposed solution essentially consists in replacing the flat-belt-like support means with flat traction surfaces by a wedge-ribbed belt. A wedge-ribbed belt has in the region of its traction surface several ribs and grooves which extend parallel in a belt longitudinal direction and the cross-sections of which have lateral flanks running towards one another in a wedge-shaped manner. When running around the drive pulley, at the periphery of which there are similarly present ribs and grooves complementary to those of the wedge-ribbed belt, the wedge-shaped ribs of the wedge-ribbed belt are pressed into the wedge-shaped grooves of the drive pulley. In that case, due to the wedge shape the perpendicular forces arising between drive pulley and wedge-ribbed belt are increased so that an improvement in the traction capability between drive pulley and belt results.

In addition, the interengagement of the ribs and grooves of the wedge-ribbed belt in those of the pulleys and rollers ensures excellent, distributed lateral guidance of the support means on several rib and groove flanks.

The elevator system according to the present invention obviously also comprises constructions with at least two support means strands (wedge-ribbed belts) arranged parallel to one another.

According to a preferred refinement of the present invention the cross-sections of the ribs and grooves of the wedge-ribbed belt are substantially triangular or trapezium-shaped. Wedge-ribbed belts with triangular or trapezium-shaped ribs and grooves can be manufactured in particularly simple and economic manner.

An advantageous compromise between the demands of running quietness and traction capability is achieved if the triangular or trapezium-shaped ribs and grooves have between their lateral flanks an angle lying between 80° and 100°.

In a particularly suitable form of embodiment of the elevator system according to the present invention wedge-ribbed belts are present in which the angle between the lateral flanks of the ribs and grooves amounts to 90°.

Wedge-ribbed belts which allow particularly small bending radii, i.e. which are suitable for use in combination with drive pulleys, deflecting rollers and support rollers with particularly small diameters, have transverse grooves on a side provided with ribs and grooves. The bending stresses, which arise during running around pulleys and rollers, in the wedge-ribbed belts are thereby substantially reduced.

In order to ensure sufficient operational safety of the elevator system several separate wedge-ribbed belts arranged parallel to one another are provided as support means.

Particularly significant advantages with respect to the torque required at the drive pulley and thus the dimensions of the drive motor as well as with respect to the overall dimensions of an elevator installation are achieved with an elevator system according to the present invention if at least the drive pulleys, but preferably also the deflecting and support rollers, have an external diameter of 70 millimeters to 100 millimeters. Past tests led to the recognition that the diverse requirements and load limits can be fulfilled in optimum manner with pulley and roller diameters of 85 millimeters.

A further advantageous development of the present invention is that the drive motor together with the drive pulley shaft and the drive pulley is mounted on a carrier which is carried by one of the car guide rails and the two counterweight guide rails. It is thereby achieved that the vertical loads acting on the drive pulley and the drive motor are for the major part conducted by way of the guide rails into the foundation of the elevator shaft and do not load the walls of the shaft.

Additional operating safety is achieved in accordance with one of the embodiments of the elevator system according to the present invention in that there is additionally mounted on the carrier supporting the drive motor a brake unit which acts on the drive pulley by way of the drive pulley shaft. The advantage of this arrangement resides in the fact that in the case of a motor failure the braking action on the drive pulley does not fail.

Ideal installation conditions for the flat-belt-like support means are achieved with an embodiment of the present invention in which the drive motor together with the drive pulley is mounted above the space taken up by the elevator car, wherein the plane of the drive pulley is arranged vertically and at right angles to a car wall at the counterweight side and approximately in the middle of the car depth, and wherein the vertical projection of the drive pulley on the counterweight side of the elevator car lies outside the vertical projection thereof, but a part of the vertical projection of the drive motor is superimposed on that of the elevator car. Such a support means arrangement allows the use of wedge-ribbed belts without twisting of the support means strands, which is necessary if for reasons of space-saving the pulley and roller planes are arranged in different directions.

A substantial saving of shaft space required laterally of the elevator car is made possible in that the support means extends downwardly from a support means fixing point present below the drive pulley, loops around a support roller of the counterweight, extends from this to the side, which is remote from the elevator car, of the periphery of the drive pulley, loops around the drive pulley, runs downwardly along a car wall at the counterweight side and subsequently forms a customary car-underlooping. In this support means arrangement there is required on the counterweight side a spacing between the elevator car and the shaft wall which is only slightly greater than the diameter of the drive pulley or the support roller. In the case of support means arrangements according to FIGS. 5 and 6 of the published application mentioned above as the state of the art a spacing of at least twice the pulley diameter is required.

According to a further embodiment of the elevator system according to the present invention the elevator car has in the region of the wedge-ribbed belt running under the elevator car at least one guide roller, which is provided with ribs and grooves, for the wedge-ribbed belt. Thus, the advantageous support means guidance described in the foregoing can also be achieved for a wedge-ribbed belt which has ribs and grooves only on its running surfaces, the ribs and grooves being radially outwardly directed in the region of the car support roller mounted below the elevator car and not being guided by those rollers.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
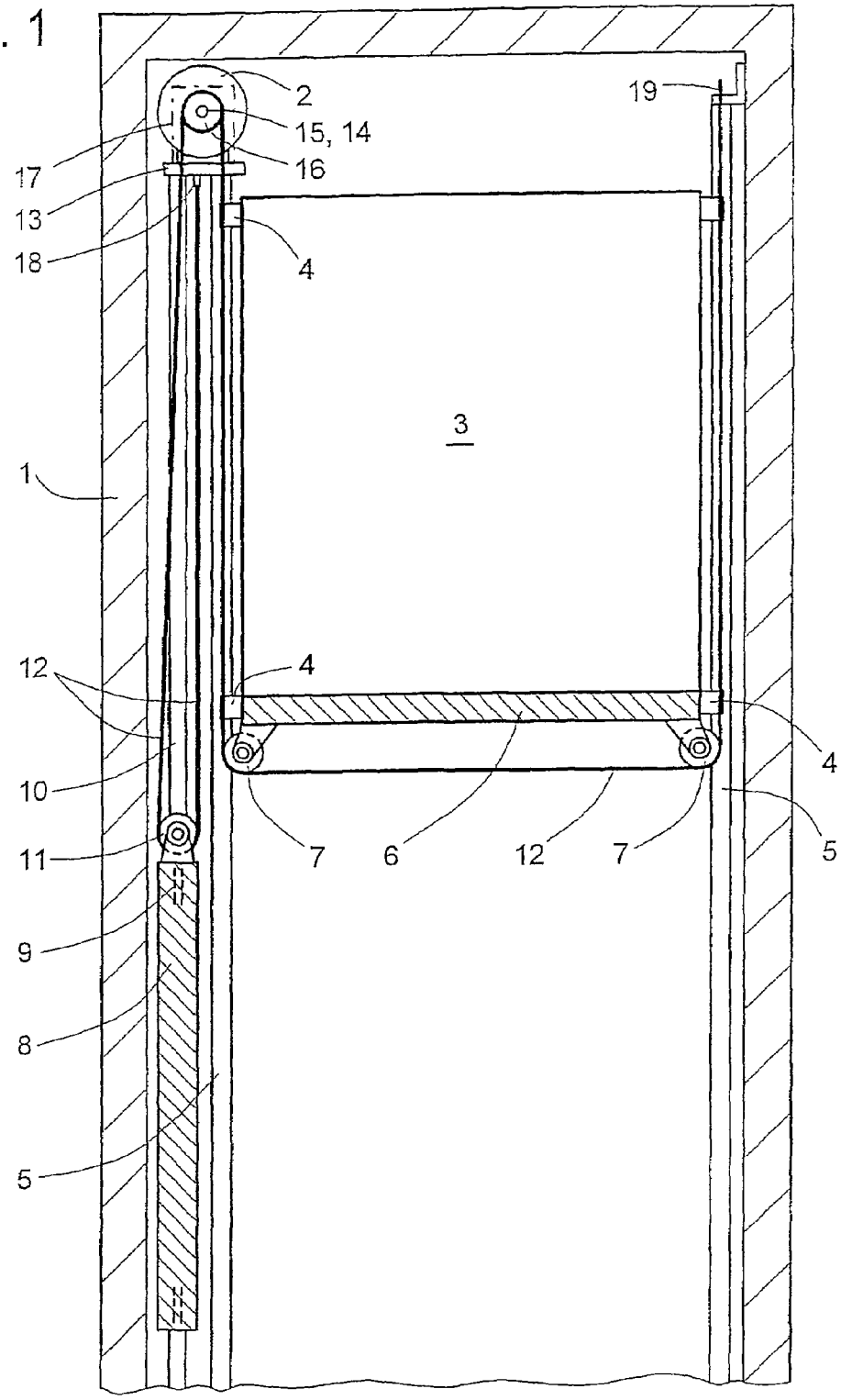
FIG. 1 is a fragmentary front elevation cross-sectional view through an elevator system according to the present invention.

FIG. 1 shows a section, which is parallel to an elevator car front, through an elevator system according to the present invention. An elevator shaft, in which a drive motor 2 moves an elevator car 3 upwardly and downwardly by way of a support means in the form of a wedge-ribbed belt 12, is characterized by the reference numeral 1. The elevator car 3 is guided by means of car guide shoes 4 at car guide rails 5 fixed in the elevator shaft 1. Mounted below a car floor 6 on both sides are car support rollers 7 by way of which the supporting and acceleration forces of the wedge-ribbed belts 12 are transmitted to the elevator car 3. A counterweight 8, which is guided by means of counterweight guide shoes 9 at two counterweight guide rails 10 and is suspended by means of a counterweight support roller 11 at the same wedge-ribbed belt 12 as the elevator car 3, is arranged on the left-hand side of the elevator car 3. The drive motor 2 is mounted above the shaft space taken up by the elevator car 3 and comprises a driven shaft 14 acting on a drive pulley shaft 15, wherein the drive pulley shaft is oriented parallel to the wall of the elevator car 3 at the counterweight side and carries at least one drive pulley 16. The drive motor 2 is fastened on a motor carrier 13 which is supported on the car guide rails 5 at the counterweight side as well as on the two counterweight guide rails 10 and is fixedly connected with these.

In addition, a controllable brake unit 17, which is here represented as invisible and which is arranged in the region of the end of the drive pulley shaft remote from the drive motor 2, is mounted on the motor carrier 13 supporting the drive motor 2 and can brake the drive pulley shaft 15 and thus the drive pulley 16. The brake unit 17 serves at the same time as a mounting for the stated end of the drive pulley shaft 15. The advantage of this arrangement resides in the fact that in the case of a motor failure the possibility of braking the drive pulley is maintained.

The plane of the drive pulley 16 is arranged at right angles to the car wall at the counterweight side and lies approximately in the middle of the car depth. The vertical projection of the drive pulley 16 lies outside the vertical projection of the elevator car 3, whereas a part of the vertical projection of the drive motor 2 is superimposed on that of the elevator car 3. The drive pulley 16 preferably has a diameter in a range of 70 to 100 millimeters.

The wedge-ribbed belt 12 serving as the support means is fastened at one of its ends below the drive pulley 16, and in the region of the vertical projection thereof, to the motor carrier 13. From this first support means fixing point 18 it extends downwardly to the side, which faces the elevator car 3, of the periphery of the counterweight support roller 11, loops around the counterweight support roller, extends from this to the side, which is remote from the elevator car, of the periphery of the drive pulley 16, loops around the drive pulley and runs downwardly along the car wall at the counterweight side, loops by 90° on the two sides of the elevator car around the respective car support rollers 7 mounted below the car and runs upwardly along a car wall remote from the counterweight to a second support means fixing point 19.

The described support means arrangement produces in each instance vertical movements of elevator car 3 and counterweight 8 in opposite sense, wherein the speed thereof corresponds with half the circumferential speed of the drive pulley 16. The special arrangement of the first support means fixing point 18 enables a smallest possible spacing between the car wall at the counterweight side and the shaft wall when no twisting of the support means is permitted, i.e. when the planes of the drive pulley 16 and the counterweight support roller 11 are to be aligned with the planes of the car support rollers 7, which is virtually invariably the case with flat-belt-like support means.

The present description always refers, for reasons of simplicity, to an elevator system with one support means strand, with one drive pulley and with each time one counterweight support roller or car support roller. However, the elevator system according to the present invention typically has at least two support means strands (wedge-ribbed belts) arranged parallel to one another, wherein the pulleys and rollers similarly present as a multiple in the case of these embodiments can be present as multiple individual elements present in parallel or as combined multiple elements. Such a multiple arrangement of wedge-ribbed belts is virtually inevitably required for establishing sufficient system safety.

Figure 2:
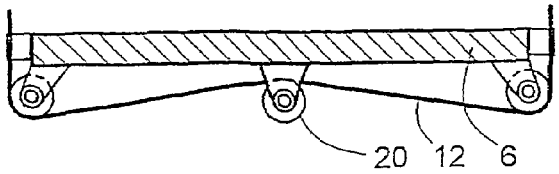
FIG. 2 is a view of an alternate embodiment of the lower looping of the support means shown in FIG. 1 around the bottom of the elevator car.

FIG. 2 shows a special alternate embodiment of the lower looping around the bottom 6 of the elevator car 3 by the wedge-ribbed belt 12. In addition to the car support rollers 7 mentioned in the foregoing there is fastened, between these, to the car floor 6 a guide roller 20 which is similarly provided with ribs and grooves.

Such a guide roller takes over lateral guidance of the wedge-ribbed belt 12 having ribs and grooves only on a running surface. Such a wedge-ribbed belt 12 is laterally guided by the car support rollers 7 without the help of the ribs and grooves, since these are directed radially outwardly during running around these car support rollers 7. Such a guidance is not, however, necessary in every case, for example not when the car support rollers are equipped with boundary discs or are of sufficient length.

Figure 3:
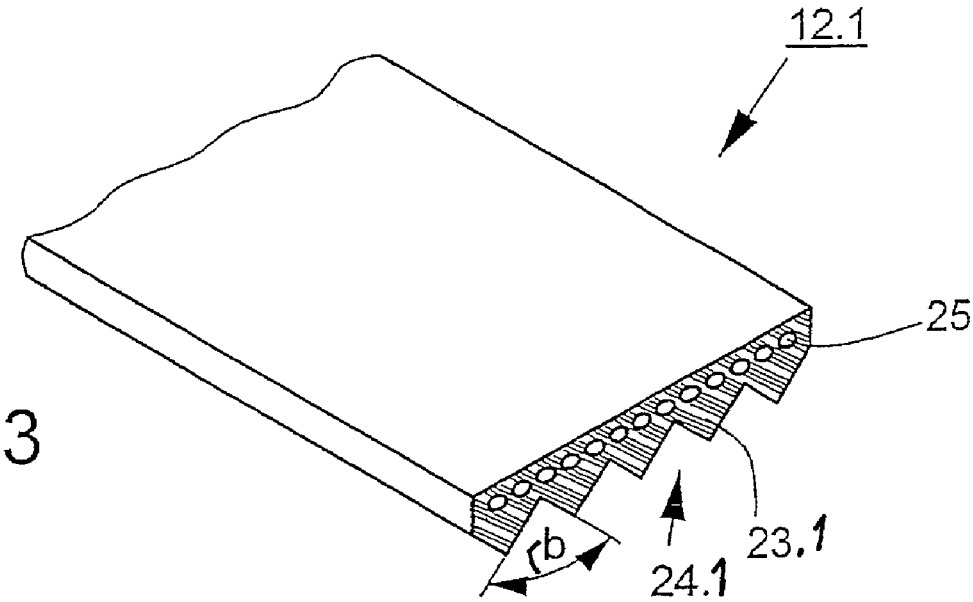
FIG. 3 is a perspective cross-sectional view of a wedge-ribbed belt according to the present invention with triangular ribs and grooves.
Figure 4:
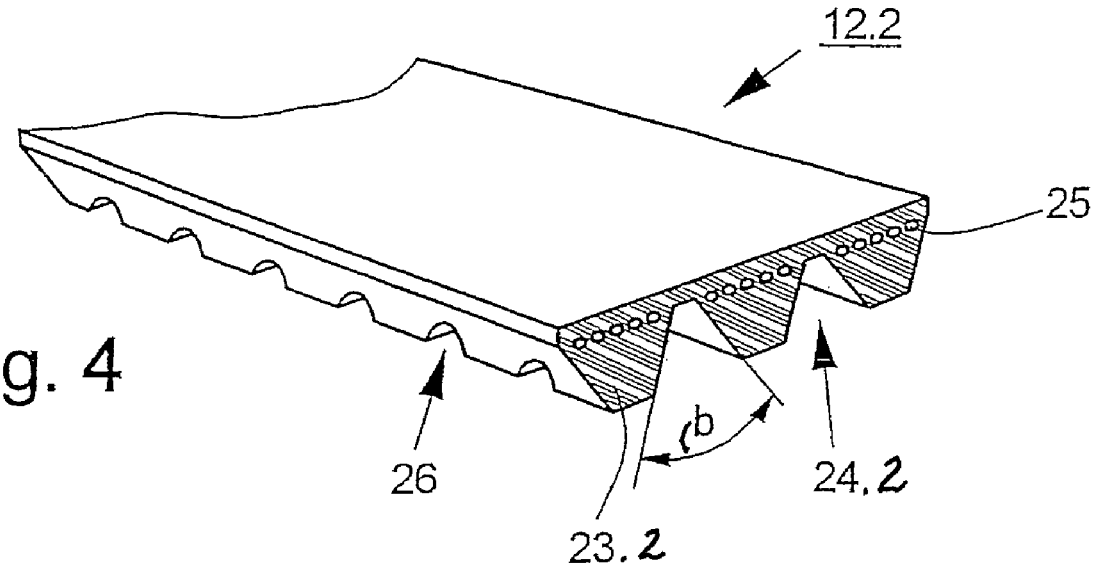
FIG. 4 is a perspective cross-sectional view of a wedge-ribbed belt according to the present invention with trapezium-shaped ribs and grooves.

FIGS. 3 and 4 show possible embodiments 12.1 and 12.2 of the wedge-ribbed belt 12, which are usable for the elevator system according to the present invention, with ribs and grooves oriented in longitudinal direction of the belt.

Preferably, at least that layer of the wedge-ribbed belt 12, which contains the ribs and grooves, is made of polyurethane. In FIGS. 3 and 4 it can also be recognized that the wedge-ribbed belt 12.1, 12.2 contains tensile carriers 25 which are oriented in the longitudinal direction thereof and which consist of metallic strands (for example, steel strands) or non-metallic strands (for example, of synthetic fibers or chemical fibers). Tensile carriers can also be present in the form of area pieces of fabric which are metallic or made of synthetic fibers. Tensile carriers impart the requisite tensile strength and/or longitudinal stiffness to the wedge-ribbed belt 12.

In the case of the embodiment 12.1 according to FIG. 3, ribs 23.1 and grooves 24.1 have a triangular cross-section. In the case of the embodiment 12.2 according to FIG. 4, ribs 23.2 and grooves 24.2 have a trapezium-shaped cross-section. An angle "b" present between the flanks of a rib or a groove influences the operating characteristics of a wedge-ribbed belt, particularly the running quietness thereof and the traction capability thereof. Tests have shown that it is applicable within certain limits that the larger the angle "b", the better the running quietness and the worse the traction capability. Advantageous properties with respect to running quietness and traction capability have been achieved simultaneously if the angle "b" lies between 80° and 100°. An optimum compromise between the opposing requirements is achieved by wedge-ribbed belts in which the angle "b" lies at approximately 90°.

A further possibility of refinement of the wedge-ribbed belt 12.2 is recognizable from FIG. 4. The wedge-ribbed belt 12.2 has, apart from the wedge-shaped ribs 23.2 and grooves 24.2, also transverse grooves 26. These transverse grooves 26 improve the bending flexibility of the wedge-ribbed element 12.2, so that this can co-operate with drive pulleys, support rollers and deflecting rollers which have extremely small diameters.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system comprising:

a drive motor mounted at a head of an elevator shaft and having a drive pulley;

an elevator car movable in the elevator shaft;

a counterweight movable in the elevator shaft and arranged laterally of said elevator car; and a belt support means supporting said elevator car by underlooping and engaging said drive pulley, said support means being a wedge-ribbed belt having a running surface facing said drive pulley and a plurality of ribs and grooves formed in said running surface and extending in parallel in a longitudinal direction of said support means, said ribs and grooves being one of triangular-shaped and trapezium-shaped in cross section and said ribs and grooves being formed with lateral flanks at an angle in a range of 80° to 100°.

2. The elevator system according to claim 1 wherein said angle is 90°.

3. The elevator system according to claim 1 wherein said wedge-ribbed belt has a plurality of transverse grooves formed in said running surface.

4. The elevator system according to claim 1 wherein said support means includes at least two wedge-ribbed belt strands arranged in parallel.

5. The elevator system according to claim 1 wherein said drive pulley has an external diameter in a range of 70 millimeters to 100 millimeters.

6. The elevator system according to claim 1 including a respective car guide rail is mounted on two opposite sides of said elevator car and two counterweight guide rails mounted on a counterweight side of said elevator car, and said drive motor together with said drive pulley being mounted on a motor carrier attached to one of said car guide rails and said two counterweight guide rails.

7. The elevator system according to claim 6 including a brake unit mounted on said motor carrier for acting upon said drive pulley.

8. The elevator system according to claim 1 wherein said drive motor and said drive pulley are mounted above a space in the elevator shaft taken up by said elevator car, a plane of said drive pulley being arranged vertically and at right angles to a car wall at a counterweight side of said elevator car and approximately in a middle of a car depth of said elevator car, a vertical projection of said drive pulley onto said counterweight side of said elevator car being outside a vertical projection of said counterweight side, and a part of a vertical projection of said drive motor being superimposed on said vertical projection of said counterweight side of said elevator car.

9. The elevator system according to claim 1 wherein said wedge-ribbed belt extends from a support means fixing point below said drive pulley and in a region of a vertical projection of said drive pulley, downwardly to a side, which faces said elevator car of a periphery of a counterweight support roller, loops around said counterweight support roller, extends to a side remote from said elevator car of a periphery of said drive pulley, loops around said drive pulley and runs downwardly along a car wall at a counterweight side of said elevator car, loops by 90° around a respective car support roller mounted below said elevator car on each of two sides of said elevator car and runs along a car wall remote from said counterweight upwardly to a second support means fixing point in the elevator shaft.

10. The elevator system according to claim 1 including a guide roller mounted at a bottom of said elevator car and engaging said wedge-ribbed belt, said guide roller having a plurality of ribs and grooves engaging said ribs and grooves of said wedge-ribbed belt for guidance of said wedge-ribbed belt.

11. An elevator car support for use in an elevator system having a drive motor mounted at a head of an elevator shaft and having a drive pulley for engaging the support, the support comprising: a wedge-ribbed belt adapted to support the elevator car by underlooping and engaging the drive pulley, said belt having a running surface adapted to face the drive pulley and a plurality of ribs and grooves formed in said running surface and extending in parallel in a longitudinal direction of said belt, said ribs and grooves being formed with lateral flanks at an angle in a range of 80° to 100°.

12. The elevator car support according to claim 11 wherein said ribs and grooves are one of triangular-shaped and trapezium-shaped in cross section.

* * * * *